United States Patent [19]

Gordon

[11] Patent Number: 4,778,442

[45] Date of Patent: Oct. 18, 1988

[54] CENTRIFUGATION

[75] Inventor: Alan J. Gordon, Liverpool, England

[73] Assignee: Shandon Southern Products Limited, Runcorn, England

[21] Appl. No.: 501,997

[22] Filed: Jun. 7, 1983

[30] Foreign Application Priority Data

Jun. 9, 1982 [GB] United Kingdom ..... 8216739
Jan. 19, 1983 [GB] United Kingdom ..... 8301459

[51] Int. Cl.[4] ..... B04B 5/02
[52] U.S. Cl. ..... 494/16
[58] Field of Search ..... 494/16, 31, 14, 20

[56] References Cited

U.S. PATENT DOCUMENTS 3,851,817 12/1974 Buck ..... 494/14
4,010,890 3/1977 Wright ..... 494/20
4,120,450 10/1978 Whitehead ..... 494/20
4,360,149 11/1982 Hein ..... 494/20

*Primary Examiner*—Robert W. Jenkins
*Attorney, Agent, or Firm*—Vaden, Eichkenroht, Thompson & Boulware

[57] ABSTRACT

A centrifuge system, especially for centrifugation of pathologically dangerous material, is characterized by a centrifuge head adapted to contain a carrier liquid and so formed and shaped that upon rotation of the head about its axis of symmetry the carrier liquid is distributed in a configuration to support one or more sealed sample containers wholly by floatation. The distribution of the carrier liquid in the rotating head may be as an annular body of constant cross section, or as two or more bodies accommodated in fluidly linked chambers in the head. The sample containers may be rigid and for instance tubular, or flexible and for instance bag-like.

6 Claims, 1 Drawing Sheet

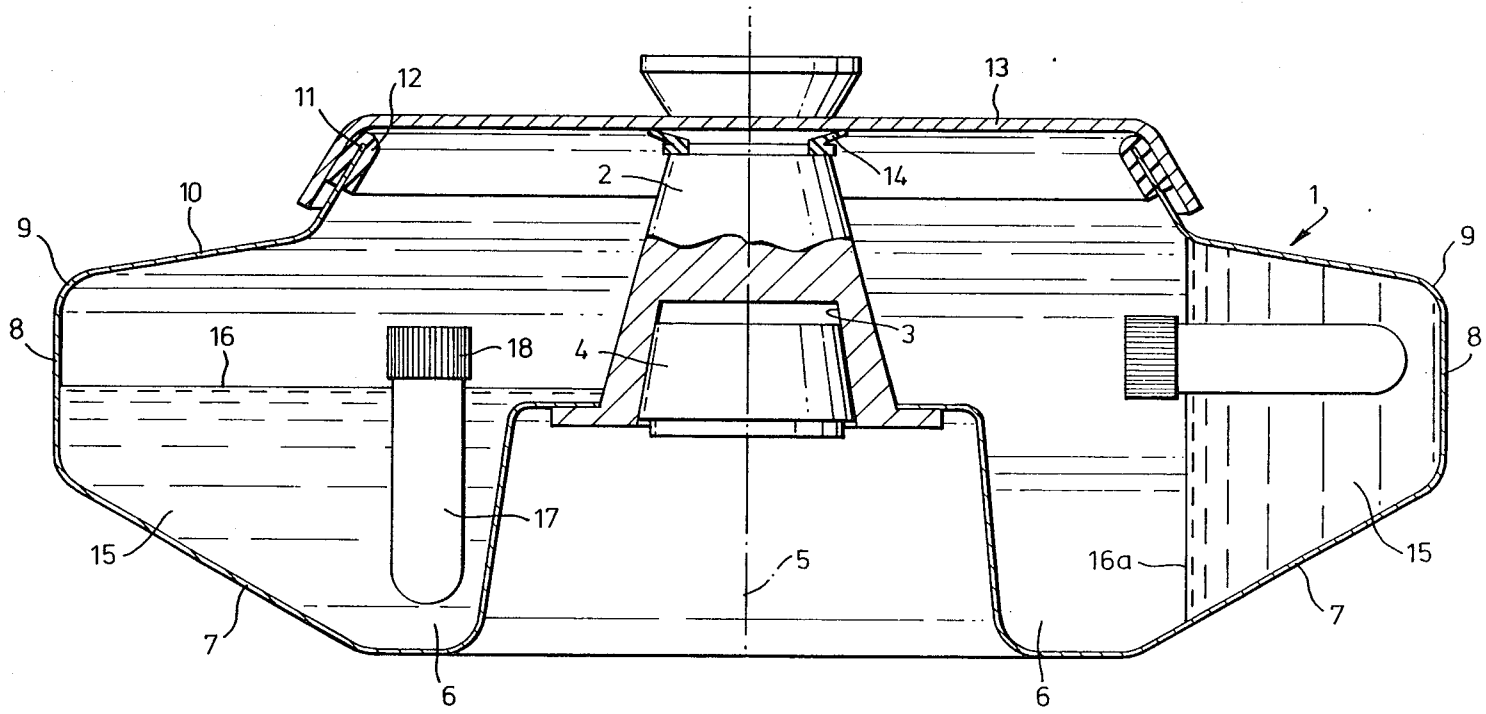
1
2
3
4
5
6
7
8
9
10
11
12
13
14
15
16
16a
17
18

CENTRIFUGATION

FIELD OF THE INVENTION

The invention relates to centrifugation. Centrifugation is a widely used technique for separating the components of fluent mixtures in accordance with their respective densities and important applications of the technique are in the life sciences for effecting separations of the components of complex biological fluids such as body fluids, for instance in diagnostic and analytical procedures.

BACKGROUND OF THE INVENTION AND THE PRIOR ART

Typically, centrifugation of a fluent mixture is accomplished by placing that mixture in a sample container carried by the head of a centrifuge in such manner that upon rotation of the centrifuge head the container rotates around the axis of rotation to allow the development, by centrifugal force, of an artificial gravitational field many times that of natural gravity and that acts upon the components of the mixture to cause stratification of these components in terms of their respective densities. Because of the extremely high centrifugal forces that are developed, and the need to achieve dynamic balance, the centrifuge head is normally equipped to carry a specific number of sample containers in such manner as to be arranged symmetrically about the axis of rotation. There are numerous proposals for, and known arrangements of, centrifuge heads for carrying containers, of various forms, in the required orientation with respect to the axis of rotation, including arrangements for carrying generally tubular containers in a manner that permits these to align their long axes with the effective gravitational field acting thereon during centrifugation and so that the fluent mixture components stratify in a regular and consistent manner, facilitating their subsequent separation from one another, and/or their examination, by various techniques. The various requirements for supporting the containers lead necessarily to significant complexity in the design of the centrifuge head.

Moreover, although the containers have to be strong to transmit to the head structure the centrifugal forces generated by the mass of their sample contents during centrifugation, because the mass of a container itself affects the loads it imposes on its supports in the centrifuge head, there is the conflicting requirement that the masses of the containers should be small to restrict the total load that they impose on their supports. For these reasons the capacity of the containers is usually a design compromise, being less than could be desirable, in order to enable the generation of high artificial gravitational fields.

It has recently been proposed, in the published U.S. Pat. No. 4,360,149 to Hein, partly to support the mass of a centrifuge container and its contents by a buoyant force resulting from the presence, in the centrifuge head, of a support liquid in which the otherwise conventionally pivotally supported tubular container is partly immersed, at least when the head is rotating during centrifugation. However, for reasons that will be discussed below, this proposal adds to the rotating mass of the centrifuge head and the strength requirements for the latter while only partly off-loading the container pivots, leaving these and the container itself still needing to carry and transmit significant stresses.

An objective of the invention is to provide a centrifugation system that avoids many of the complexities and design constraints of conventional centrifugation systems, by utilizing buoyant support for the sample container(s), but that also avoids the disadvantages of the aforesaid proposal of U.S. Pat. No. 4,360,149 to Hein.

Particularly when centrifugation is applied in the life sciences to pathologically dangerous fluent mixtures, precautions need to be taken to prevent the escape of materials from the sample containers and to provide for ready sterilisation of any components of the centrifuge that may become contaminated as a result of spillage of such materials or, perhaps, as a result of breakage of the containers. Such requirements lead to further complications in the design and operation of the centrifuge.

Another objective of the present invention is, therefore, to provide a centrifugation system that, in addition to achieving the above-discussed objective, also avoids many of the complications of the known and currently proposed systems for centrifuging materials that are physically or pathologically dangerous, while providing significant versatility of operation to facilitate its ready use in a busy laboratory.

THE INVENTION

A centifugation system in accordance with the invention is characterised by a centrifuge head adapted to contain a carrier liquid and so formed that upon rotation of the head about its axis of symmetry said carrier liquid is distributed in a configuration such as to be capable of supporting, wholly by floatation, one or more sample containers of sealed or sealable form and in an orientation appropriate to centrifugation of the contents thereof.

Preferably the centrifuge head is sealable by a detachable closure and while the configuration may be such that a seal between the body of the head and the closure at their juncture will be submerged by the carrier liquid when this distributes itself under centrifugal loads during rotation, it is preferred that the juncture between the closure and the body of the head shall be inboard of the carrier liquid surface when this is distributed as aforesaid.

The sample container(s) may be of any desired configuration and subject only to the constraint that when loaded with a fluent sample and sealed, such a container shall float in the chosen carrier liquid with a stable orientation. For many purposes a tubular container adapted to float with its long axis upright is advantageous, but other container configurations may be preferable for specific centrifugation applications.

Because in the system of the invention the or each sample container is wholly supported by floatation during centrifugation, it need have no physical attachment to the centrifuge head structure, so that the usual arrangements for pivotally supporting the containers in a conventional centrifuge, or in a centrifuge as proposed in U.S. Pat. No. 4,360,149 to Hein, are not required and their mass may be avoided in the system of the invention. For the same reason, the or each sample container is not required to sustain and transmit centrifugal force mechanically to the head structure and needs, in general, to have only sufficient strength to provide the required containment of its contents and to resist residual hydrostatic pressure differences. Indeed, for certain applications, thin-walled, light-weight, flexible bag-like containers may be advantageous.

The centrifuge head is desirably a simple body of revolution so that the carrier liquid, under centrifugal loads when the head is rotated about its axis of symmetry, distributes itself as an annular liquid body of constant cross-section around the periphery of the head. With such a configuration there is no constraint upon the number of sample containers (up to a maximum determined by accommodation as discussed below) that may be floated in the carrier liquid for centrifugation of their contents in any one operation. However, the centrifuge head might be sub-divided into two or more chambers each containing carrier liquid and linked to permit the latter to distribute itself amongst the chambers during centrifugation, each chamber being adapted to receive one or more sample containers for floatation in the carrier liquid therein.

It should be appreciated that because a floating body displaces exactly its own weight of the liquid in which it floats, it is immaterial to the dynamic balance of the centrifuge head whether or not a number of sample containers are distributed symmetrically around the axis of rotation of the head during centrifugation. Thus centrifugation may be carried out with the head loaded with any required number of sample containers up to a maximum determined by accommodation and acceptable stressing of the particular centrifugation operation, without regard to considerations of dynamic balance since this will be unaffected by the number and distribution of the sample containers, for the reason discussed. Moreover dynamic balance will not be affected by conducting a centrifugation operation with the head loaded with a variety of sample containers of different configuration and/or volume.

Because of the ease with which the head may be loaded and unloaded with sample containers, the filling of containers with sample materials and the sealing thereof may be conducted under suitably controlled containment conditions remote from the centrifuge, as may also the unsealing and subsequent handling of the containers and their centrifuged contents after a centrifugation operation.

The head is however preferably constructed to be readily detachable from the drive mechanism of a centrifuge so as to be capable of being loaded and unloaded with sample containers under conditions of containment where this is required by the nature of the sample material.

A tubular container that always floats with its long axis upright, i.e. aligned with the effective gravitational field instantaneously acting on it is advantageous for may centrifugation applications because its use makes uniform and consistent stratification of sample components routinely available to the operator without the need for exercising any special care in handling the container during loading and unloading of the head with one or more such containers.

Because there is no mechanical connection between a sample container and the head, and the stresses imposed upon the container during centrifugation are minimised as above explained, a suitable sample container may be of simple construction and be, for instance, in the form of a simple glass or like tube that may be of such low cost as to be treated as a disposable item, avoiding the need for cleansing and sterilization for reuse and the concomitant labour and cost thereof.

Moreover it should be understood that because a sample container is subjected to equal fluid pressures internally and externally during centrifugation it requires no external mechanical support against bursting and the risk of breakage of even a thin-walled glass container, during centrifugation, is slight. However the consequences of a container breakage during centrifugation are significantly less serious than a sample container breakage in a conventional centrifuge, because the fragments of a container and its contents will merely settle, in accordance with their respective densities, in the carrier liquid under the influence of relatively small net forces. If required the carrier liquid may be so chosen as to counteract the potential hazards of escape of the sample material is question: for instance in the case of sample material of a pathogenic nature the carrier liquid may be or contain a material effective to destroy the pathogens of the sample.

For may centrifugation operations the carrier liquid may be water that, for the reasons discussed above, may contain a "disinfectant" or other material capable of neutralising or counteracting the effect of an escape of sample material into the carrier liquid and chosen having regard to the sample material being subjected to centrifugation.

THE DRAWING

The single FIGURE of the accompanying drawing is a diagrammatic axial section of a centrifuge head embodying the invention and illustrating, on one side, the disposition of a sample container and the carrier liquid when the head is at rest and, on the other side, the corresponding disposition of a sample container and the carrier liquid during rotation of the head in the course of a centrifugation operation.

DESCRIPTION OF AN EMBODIMENT

The drawing shows a centrifuge head comprising a body 1 formed mainly as a sheet metal bowl attached to a central hub 2 provided with a taper bowl 3 adapted to fit a correspondingly tapered drive element 4 on the vertical shaft of a suitable motor (not shown) and by means of which the head 1 may be spun at high speed about the vertical axis indicated at 5. The body 1 has the configuration of a simple body of revolution, symmetrical about the axis 5.

The bowl of the body 1 is shaped so that adjacent to the hub 2 it defines a relatively deep trough 6 outboard of which the bottom 7 of the body slopes upwardly and outwardly to a vertical sidewll 8 that extends upwardly to a shoulder 9 joining a top wall 10 that extends inwardly and somewhat upwardly to a rim 11 carrying a seal 12.

The centrifuge head further comprises a detachable closure in the form of a cover 13 shaped so as to overlie and engage the seal 12 and having means (not shown in detail) for securing it to the hub 2. A seal 14 on the hub is disposed to engage the underside of the cover 13.

Conveniently the construction of the hub 2 and the manner of attaching the cover 13 thereto are as described in my earlier U.S. patent application Ser. No. 289,374 filed Aug. 3, 1981 (now U.S. Pat. No. 4,391,710).

In operation, the head 1 is adapted to contain a carrier liquid shown at 15 in the drawing, the left-hand half of which shows the situation with the head at rest so that the carrier liquid surface 16 is horizontal. It will be noted that the carrier liquid fills the trough portion 6 of the bowl of the head to a depth sufficient to float, with its axis upright, a generally tubular sample container 17 shown, diagrammatically, as a simple tube having a detachable sealing cap 18. It should however be understood that the sample container may have any other desired configuration and may be adapted for closure by heat-sealing (glass fusion) techniques rather than by way of a closure cap as shown.

The right-hand half of the drawing shows the situation when the head is rotated abut its axis 5 at high speed to accomplish centrifugation of material contained in the sample container 17. As shown, the carrier liquid 15 distributes itself about the periphery of the head with its surface 16*a* vertical and providing an annular body of carrier liquid of uniform crosssection and of a depth sufficient to float the sample container 17 with its long axis horizontal so that the artificial gravitational field upon the sample container contents, due to centrifugal force, acts along the long axis of the container to accomplish uniform stratification of the container contents, in accordance with their relative densities, in layers perpendicular to the axis of the container.

I claim:

1. A centrifugation system comprising:

a carrier liquid; and a centrifuge head adapted to contain said carrier liquid; and a sealable sample container having no mechanical connection to said centrifuge head and adapted to float freely in said carrier liquid, whereby upon rotation of said centrifuge head about its axis of symmetry, said carrier liquid is distributed in a manner as to be capable of supporting said sample container wholly by flotation.

2. The centrifugation system of claim 1, in which said centrifuge head is sealable by a detachable closure.

3. The centrifugation system of claim 2, in which the configuration of said centrifuge head is such that the juncture between said closure and the body of said head is inboard of the carrier liquid surface when said carrier liquid is distributed by rotation of said head.

4. The centrifugation system of claims 1, 2, or 3 in which said centrifuge head is a simple body of revolution.

5. The centrifugation system of claim 1, in which said centrifuge head is constructed to be readily detachable from the drive mechanism of the centrifugation system.

6. The centrifugation system of claim 1, including a sample container of tubular configuration adapted to float in said carrier liquid with the long axis of said container aligned with the effective instantaneous gravitational field acting thereon.

* * * * *